US009016470B2

(12) United States Patent
Scarpa et al.

(10) Patent No.: US 9,016,470 B2
(45) Date of Patent: Apr. 28, 2015

(54) CLOSING DEVICE FOR A CONTAINER AND CONTAINER COMPRISING SAID CLOSING DEVICE

(75) Inventors: Germano Scarpa, Udine (IT); Luigi Cogolo, Udine (IT)

(73) Assignee: BioFarma Spa, Mereto di Tomba (IT)

( * ) Notice: Subject to any disclaimer, the term of this patent is extended or adjusted under 35 U.S.C. 154(b) by 28 days.

(21) Appl. No.: 13/824,835

(22) PCT Filed: Sep. 15, 2011

(86) PCT No.: PCT/IB2011/002151

§ 371 (c)(1),
(2), (4) Date: Mar. 18, 2013

(87) PCT Pub. No.: WO2012/035417

PCT Pub. Date: Mar. 22, 2012

(65) Prior Publication Data

US 2013/0175188 A1 Jul. 11, 2013

(30) Foreign Application Priority Data

Sep. 17, 2010 (IT) ..... UD2010A0167

(51) Int. Cl.
*B65D 25/08* (2006.01)
*B65D 81/32* (2006.01)
*B65D 51/28* (2006.01)

(52) U.S. Cl.
CPC ..... *B65D 81/32* (2013.01); *B65D 51/2821* (2013.01); *B65D 2101/0023* (2013.01); *B65D 2213/00* (2013.01); *Y10S 215/08* (2013.01)

(58) Field of Classification Search
USPC ..... 206/219, 221, 222; 215/DIG. 8; 222/129
See application file for complete search history.

(56) References Cited

U.S. PATENT DOCUMENTS 5,884,759 A 3/1999 Gueret
2006/0144727 A1 7/2006 Fontana
(Continued)

FOREIGN PATENT DOCUMENTS

DE 10 2006 055083 B3 5/2008
EP 2 186 748 A1 5/2010
(Continued)

OTHER PUBLICATIONS
International Search Report and Written Opinion for PCT/IB2011/002151 issued Feb. 22, 2012 (6 pages).

*Primary Examiner* — David Fidei
(74) *Attorney, Agent, or Firm* — Flaster/Greenberg, P.C.

(57) ABSTRACT

A device for closing a container, in which to contain a first component to be introduced into the container in addition to a second component, comprising a tank for the first component, a mobile thruster by means of which to determine the opening of the tank, a closing portion stably associated with the tank and provided with closing means able to cooperate with a neck of the container to determine a releasable clamping. The closing portion houses slidingly inside it at least a part of the mobile thruster and has an opening for the passage of the mobile thruster toward the tank. The mobile thruster is selectively mobile between a first raised position of non-interference with the tank and a second lowered position in which it determines the opening of the tank to allow the passage of the first component inside the container. The mobile thruster is made by molding in a single piece with the closing portion, defining a profile of preferential breakage connecting said mobile thruster and said closing portion. A safety element is also provided, made in a single piece both with respect to said mobile thruster and also with respect to the closing portion, to prevent an accidental reciprocal movement of said mobile thruster with respect to said closing portion.

58 Claims, 6 Drawing Sheets

(56) References Cited

U.S. PATENT DOCUMENTS

| | | | | |
|---|---|---|---|---|
| 2007/0012580 | A1 | 1/2007 | Lee | |
| 2008/0116221 | A1 * | 5/2008 | Roth et al. | 222/129 |
| 2011/0024454 | A1 * | 2/2011 | Dyrbye et al. | 222/129 |
| 2012/0217178 | A1 * | 8/2012 | Rohr et al. | 206/219 |

FOREIGN PATENT DOCUMENTS

| | | | |
|---|---|---|---|
| JP | 2010 052786 | A | 3/2010 |
| WO | WO 00/53507 | A1 | 9/2000 |

* cited by examiner

CLOSING DEVICE FOR A CONTAINER AND CONTAINER COMPRISING SAID CLOSING DEVICE

CROSS-REFERENCE TO RELATED APPLICATIONS

This Application is a U.S. National Phase Filing Under 35 U.S.C. §371 based on PCT/IB2011/002151, filed Sep. 15, 2011, the entire disclosure of which is incorporated by reference herein.

BACKGROUND OF THE INVENTION

1. Field of the Invention

The present invention concerns a closing device by means of which to introduce a first component inside a container or flacon comprising a second component, typically a liquid, and a flacon comprising said closing device. In particular the closing device according to the present invention is the type provided with a tank suitable to preserve, in an isolated environment, the first component, generally a substance soluble in the second component, such as a powder, tablet or similar, hygroscopic or water-soluble, to be mixed, dissolved, solubilized or in any case dispersed in the second component in order to prepare a composition to be taken by the user. The closing device also comprises a mobile thruster which opens the tank, freeing the first component into the second component. The closing device, and associated flacon, is typically but not exclusively applied in the field of food supplements, for example vitamins, freeze-dried bacteria with a probiotic and prebiotic effect or other, for domestic use, in the field of sport, in the pharmaceutical sector and in that of medical devices.

2. Description of Related Art

Closing devices for flacons are known, suitable to preserve a first component, for example a hygroscopic powder, and to voluntarily free it into a second component, in which it is soluble or dispersible, contained in the flacon, generally a liquid, usually used to prepare and take compositions, such as food supplements, drugs, medical devices, in the medical and/or sports fields.

Known closing devices provide at least a closing portion or stopper, which is screwed in or coupled under pressure on the neck of the flacon. The stopper is associated with a preservation tank for the first component and also comprises a mobile perforator which allows the user to perforate the tank in through manner and free the first component that falls into the second component, generally dissolving therein for the preparation of the composition to be taken.

An example of a known closing device is described in the international application WO-A-00/53507 (WO'507).

In application WO'507, the user activates the perforator to cut the tank and make the first component pass inside the flacon, where it can mix or disperse in the second component, to prepare the composition to be taken, for example as a food supplement. In the solution described in WO'507, once the composition to be taken has been prepared, the user activates a selective opening mechanism integrated into the stopper, which frees a through drinking path from the flacon through the closing portion, allowing the prepared composition to pass. Therefore, in WO'507, the user does not remove the stopper from the flacon in order to drink the composition prepared, on the contrary, he uses the stopper as a spout through which he drinks the composition. However, this entails a considerable mechanical complication of the solution adopted to produce the stopper, with a consequent increase in production costs.

In application WO'507, the tank containing the first component is a blister or alveolus or capsule consisting of a sheet of aluminum coupled with an external layer of polymer, typically polyethylene, which defines a conformation with a planar wall from which a hollow protuberance extends in which the first component is disposed. The blister normally guarantees the hydraulic seal and therefore the fact that the first component is not subjected to degradation due to humidity.

The blister is disposed with the hollow protuberance facing toward the inside of the flacon and with the planar wall facing upward, glued to an internal annular surface of the closing portion above.

Moreover, the blister is maintained in this position due to the effect of the pinching of a peripheral part thereof between one edge of the neck of the flacon and the internal annular surface itself.

Therefore, in the solution described in WO'507, it is only the closing pressure that determines the hydraulic seal of the flacon, to prevent the second component, typically a liquid, from leaking out.

However, it is not possible to guarantee that the pressure will remain unchanged over time, especially due to possible impacts and/or friction of the device and the flacon against other similar ones, for example during transport or packaging, or due to possible heat dilations of the stopper with respect to the neck of the flacon.

Consequently, known closing devices are not completely reliable as far as the hydraulic seal of the flacon is concerned.

Another disadvantage of known devices is that, to prevent the mobile perforator from being actuated accidentally, a safety element is provided, made separately, and assembled in snap-in fashion on an external segment of the mobile perforator, so as to make the latter substantially a complete whole with the stopper.

In this solution, since it is necessary to guarantee a certain solidity of the snap-in coupling, the safety element is difficult to remove, particularly by elderly or ill people who may be users of this type of devices.

Furthermore, the fact that the safety element is made separately entails an increase in the production costs.

Purpose of the present invention is to obtain a closing device containing a first component for a flacon containing a second component, which is simple and economical to make and which allows to overcome the above disadvantages of known devices.

The Applicant has devised, tested and embodied the present invention to overcome the shortcomings of the state of the art and to obtain these and other purposes and advantages.

BRIEF SUMMARY OF THE INVENTION

The present invention is set forth and characterized in the independent claims, while the dependent claims describe other characteristics of the invention or variants to the main inventive idea.

In accordance with the above purpose, a device for closing a flacon, or similar or comparable container, is suitable to contain a first component to be introduced into the flacon in addition to a second component contained in the flacon, to prepare a composition to be taken for example, but not restrictively, as a food supplement.

The first component is typically a substance, for example a food or pharmaceutical substance or a medical device, sensitive to humidity, soluble in the second component, such as a hygroscopic or water-soluble powder or tablet or other. The second component is generally a liquid suitable to be taken by a user.

The closing device according to the present invention comprises at least a tank suitable to contain the first component, a mobile thruster by means of which to open the tank, a closing portion stably associated with the tank and provided with closing means, for example a screw, pressure, jointing, snap-in or other, able to cooperate with the neck of the flacon to determine a releasable clamping with the flacon.

The closing portion is suitable, in one condition of use, to slidingly house inside it at least one part, for example rod-shaped, or cross-shaped or other shape, of the mobile thruster and has an aperture to allow the mobile thruster to pass to the tank.

The mobile thruster is selectively mobile, sliding in the closing portion when the user thrusts upon it, between a first raised position of non-interference with the tank and a second lowered position in which it causes the tank to open so that the first component can pass inside the flacon. The closing portion has an annular surface facing, in use, toward the inside of the flacon, which surrounds the aperture and extends radially from the aperture to the closing means. The tank is stably associated with the annular surface.

In some forms of embodiment, the closing portion has an external cylindrical wall which extends downward from the annular surface and is provided with closing means to cooperate with the container, and an internal cylindrical wall which extends upward from the annular surface and which provides an aperture, suitable for the sliding passage of the mobile thruster.

According to one feature of the present invention, the mobile thruster is made by molding in a single piece with the closing portion, defining a profile of preferential breaking connecting the mobile thruster and the closing portion, along a desired line of weakening of the material.

This allows to obtain the closing device substantially in two pieces, that is, the closing portion made in a single piece with the thruster, and the tank for the first component which is associated with it, with a consequent simple execution and industrialization.

In some forms of embodiment, the mobile thruster is normally made in its first raised position, with respect to the closing portion.

In this way, the user exerts a pressure on the mobile thruster until the profile of preferential breaking is broken, and thus moves the mobile thruster from the first position to the second position, to open the tank.

Furthermore, according to the present invention, the closing device comprises a safety element made in a piece both with respect to the mobile thruster and also with respect to the closing portion, to prevent an accidental reciprocal movement of the mobile thruster with respect to the closing portion. In this way therefore, the mobile thruster is prevented from inadvertently causing the tank to open, preventing unwanted leakages of the first component from the tank. The safety element also functions as a guarantee and control against tampering. In some forms of embodiment, the closing portion also comprises an annular rib which extends, in normal use, toward the inside of the flacon from the annular surface.

The annular rib is made in an intermediate position between the aperture and the closing means.

In this way, on an external side, an annular interstice is defined, delimiting a first crown of the annular surface in which to house a part of the neck of the flacon for the closing cooperation with the closing means, and on an internal side, a second crown of the annular surface, for the stable positioning of the tank.

In particular, an upper annular band of the neck, advantageously mating with the shape of the annular rib, cooperates with the annular rib, determining a slight lateral flexion thereof, to obtain the seal.

With the present invention therefore a double hydraulic seal is obtained, that is, a more external hydraulic seal determined by the annular rib that extends directly from the annular surface above the closing portion and defines the external annular interstice where the upper annular band of the neck of the flacon cooperates in abutment, and a more internal hydraulic seal as the result of the stable constraint, for example by means of gluing or heat-welding, of the tank to the annular surface of the closing portion, but in a more internal position with respect to the annular rib.

In some forms of embodiment of the present invention, the first crown allows the isolated housing of one edge and the upper annular band of the neck of the flacon in the annular interstice.

In some forms of embodiment according to the present invention, the second crown is conformed to allow to dispose, by gluing or heat-welding, the tank on top of the crown, so that the tank is in both a condition of interference with the travel of the mobile thruster, and is also, during use, facing toward the inside of the flacon.

In this way, the tank is sealed and kept in its operating position, for example by gluing or heat-welding, on the annular surface of the closing portion, and is released and separated physically from the closing cooperation zone between the closing means of the closing portion and the neck of the flacon.

Therefore, with the solution according to the present invention, the hydraulic seal of the flacon and the stable positioning of the tank are completely autonomous from each other and also with respect to the closing pressure between closing device and flacon.

This solution thus allows to guarantee the hydraulic seal over time, without any risk of accidental impacts during transport and/or heat deformations of the parts being able to influence the initial conditions.

Furthermore, by releasing the positioning of the tank from the closing pressure between device and flacon and from the hydraulic seal of the flacon itself, it is possible to produce, market, store and other the device autonomously with respect to the flacon, giving the advantage of lower production costs and greater possible commercial applications of the product.

According to a variant, the annular rib is tapered, that is, it has a development or section that progressively narrows toward the center, developing toward the annular surface. In this way, the annular rib may be subjected, during closure, to a slight elastic deformation in the step of cooperating with the neck of the flacon, reducing the surface in contact with the neck, so that it is therefore possible to increase the contact pressure at different points between annular rib and flacon, which substantially affects the neck of the flacon along one circumference, consequently improving the stability of the mechanical constraint.

In this way, in the assembled condition, an elastic effect is generated against the internal surface of the neck of the flacon, so as to guarantee the hydraulic seal of the coupling effected.

In some forms of embodiment, the closing device comprises an annular packing associated with the closing portion.

In some variant solutions, the annular packing is disposed between the annular surface of the closing portion and the upper annular band of the neck.

In other variant solutions, the annular packing is disposed between the tank and an upper annular band of the neck.

According to some forms of embodiment of the present invention, the closing portion has inside it guide ribs cooperating with the mobile thruster in its passage from the first position to the second position.

In variant solutions, the mobile thruster is provided with sliding teeth able to cooperate with the guide ribs.

In some variant forms of embodiment, the guide ribs have an axial development mainly along a helical trajectory.

In some forms of embodiment, the safety element is connected to the mobile thruster and to the closing portion by means of relative pre-cut segments that facilitate the removal of the safety element before the device is used.

Each pre-cut segment, by its conformation, thus facilitates the removal of the safety element for example by elderly people or the sick.

In other forms of embodiment, an anti-tampering element is provided, associated both with the closing portion of the flacon and also to the flacon in order to selectively prevent any decoupling. In some forms of embodiment, the anti-tampering element is an annular strip that connects the closing device to the flacon. It has a structure that surrounds the flacon and is solid with it and with the closing device, in practice preventing any decoupling. Said strip has segments of preferential breaking which, once forced, allow to remove the strip and to decouple the closing device.

According to another variant, the mobile thruster has a first gripping end and a second pointed end to actuate the breakage of the tank in the passage between the first and the second position. In some forms of embodiment the second pointed end has a substantially star-shaped section, which entails that the cutting profile of the tank is clean, uniform and sufficiently large, optimal for the exit of the first component.

According to some forms of embodiment, the mobile thruster is formed by walls that intersect orthogonally. In variant forms of embodiment, the mobile thruster has inclined segments.

According to some forms of embodiment, the closing device comprises clamping means configured to determine the mechanical clamping of the mobile thruster in the second position.

In some forms of embodiment, the tank is made of metal and a polymer, suitable to guarantee an effective barrier against humidity and oxygen, to preserve the properties of the first component contained therein, and its weldability to the closing portion.

One metal that can be used for this barrier effect can be for example aluminum.

The polymer is advantageous in particular to allow the heat-welding or gluing of the tank to the annular surface of the closing device. One suitable polymer can be polyethylene, for example LLDPE, LDPE, MDPE or HDPE or mixtures thereof. Or another solution may provide to use polypropylene, for example biaxially oriented polypropylene.

In some forms of embodiment, the tank is obtained from a sheet of metal coupled with a polymer, or a mixture of polymers for example of the type mentioned above, mono- or multilayer.

The solution with a metal sheet allows to confer desired mechanical and structural properties on the tank.

Another variant form of embodiment provides to use a film formed by one or more polymers, for example as mentioned above, in a mixture, mono-layer or possibly multilayer, on which a thin layer of metal, typically aluminum, is deposited, for example using the metal vapor deposition technique.

According to some forms of embodiment, the tank comprises a planar wall and a hollow protuberance for containing the first component. In some variants, the planar wall faces toward the mobile thruster and the protuberance faces toward the inside of the flacon, whereas in other variants the planar wall faces toward the inside of the flacon and the protuberance faces toward the mobile thruster.

The present invention also concerns a container, or flacon, comprising a closing device as described above.

In some forms of embodiment, the closing device and the associated flacon are made of plastic or elastic-plastic material compatible with use in the field of food, pharmaceutics or medicine.

BRIEF DESCRIPTION OF THE SEVERAL VIEWS OF THE DRAWINGS

These and other characteristics of the present invention will become apparent from the following description of a preferential form of embodiment, given as a non-restrictive example with reference to the attached drawings wherein.

Figure 1:
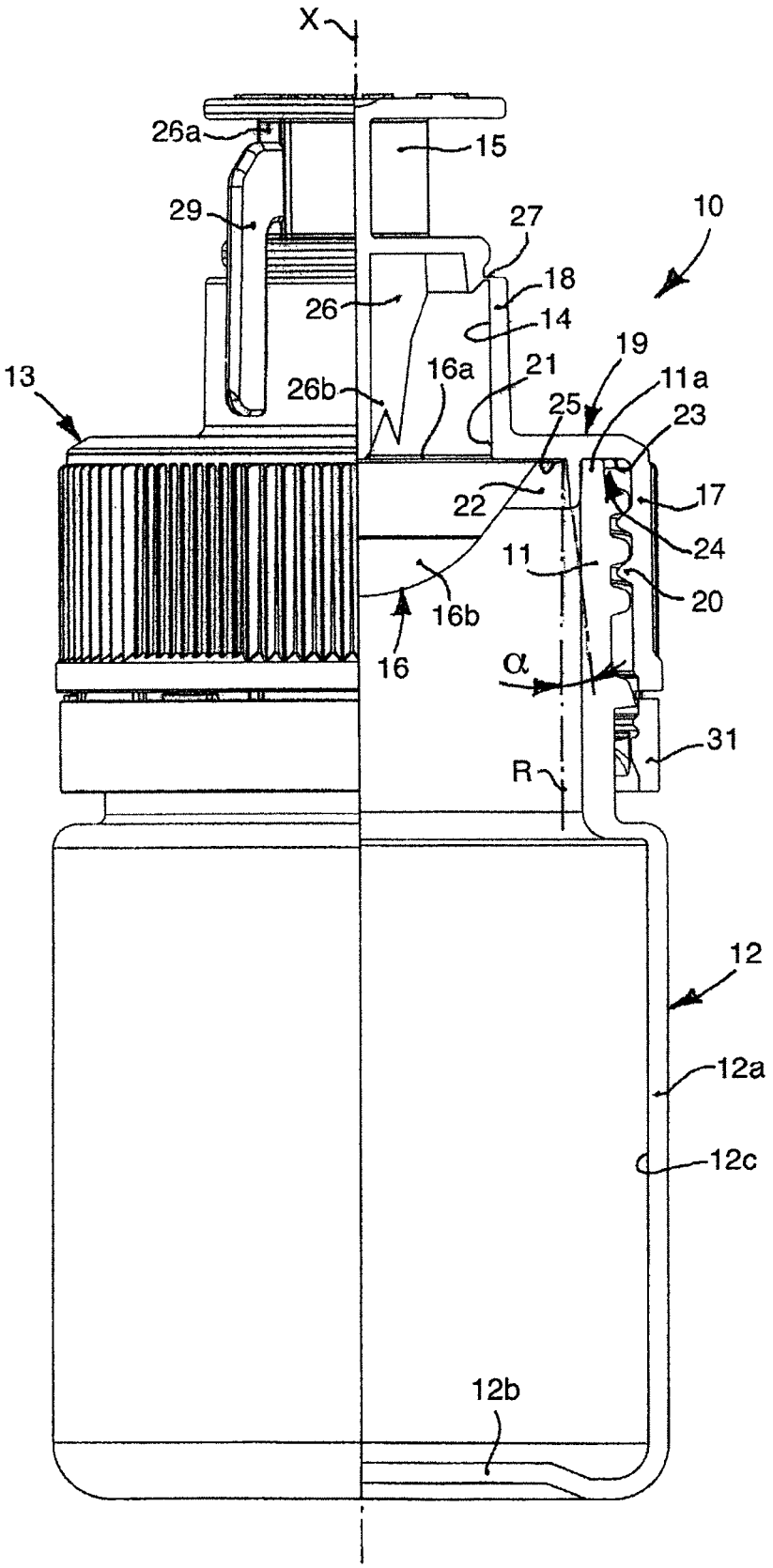
FIG. 1 shows a lateral, partly sectioned view of a device according to the present invention applied to a flacon.

To facilitate comprehension, the same reference numbers have been used, where possible, to identify identical common elements in the drawings. It is understood that elements and characteristics of one form of embodiment can conveniently be incorporated into other forms of embodiment without further clarifications.

DETAILED DESCRIPTION OF THE INVENTION

With reference to the attached drawings, a closing device 10 according to the present invention is shown in its entirety, and is suitable to contain a first component, typically a substance sensitive to humidity such as a hygroscopic or water-soluble powder or tablet, for example based on food supplements, vitamins, freeze-dried bacteria, or other prebiotic or probiotic food substances which in this case is introduced in addition to a second component contained in an associated flacon, or container, 12, for example a liquid such as water, fruit juice, other water solutions, yogurt or in general other substances in which the first component is soluble or dispersed, to prepare a composition to be drunk, for example as a food supplement.

The flacon 12 is of the traditional type and has a lateral shell 12*a* and a base 12*b* that delimit an internal compartment 12*c* for containing the second component. The lateral shell 12*a* has a neck 11 at the top that delimits an aperture, which can easily be used to have access inside the flacon 12, for example to introduce the second component therein during the production step, or, during normal use by a user, to add the first component or, once the first component has been mixed with or dispersed in the second component, so as to drink the content of the flacon 12, for example directly from the neck 11, once the closing device 10 has been removed.

The closing device 10 in particular is selectively connectable in a releasable manner, by screwing as in the attached drawings, or by jointing or other releasable connection mean, to the neck 11 of the flacon 12.

In particular, the closing device 10 comprises a closing portion or stopper 13 that develops around a central axis X, and a mobile thruster 15 able to be actuated linearly.

The mobile thruster 15 is made by molding in a single body with the closing portion or stopper 13.

The closing device 10 is associated with or also comprises a tank, in this case a blister or alveolus or capsule 16, suitable to contain the first component and protect it from humidity.

In some forms of embodiment, the blister may be formed for example by a sheet of aluminum coupled with polyethylene.

The blister or alveolus may define a typical structure with a planar wall 16*a* from which a hollow protuberance 16*b* extends, convex in shape and which contains the first component.

The mobile thruster 15 is able to be actuated linearly to cause the tank 16 to open, so that the corresponding content passes inside the flacon 12. To this end, in some variants the mobile thruster 15 completely cuts or perforates the tank 16 in a through manner, whereas in other variants it only makes a compression or thrust on the tank 16 which causes a portion of it to open, as explained in more detail hereafter.

In some forms of embodiment, the closing stopper 13 comprises a first outer cylindrical wall 17 that develops around the central axis X, with a diameter correlated to the diameter of the neck 11 of the flacon 12, which functions as a closing mean for connection to the flacon 12.

Moreover, according to some variants, the closing stopper 13 comprises a second internal cylindrical wall 18, coaxial with the first wall 17, inside which the mobile thruster 15 is suitable to slide. The second wall 18 has a smaller diameter than that of the first wall 17, correlated to the transverse sizes of the mobile thruster 15.

In some forms of embodiment, the second wall 18 delimits internally a blind axial seating 14 in which, in a condition of use, the mobile thruster 15 is able to slide and which opens, through a central aperture 21 for the passage of the mobile thruster 15, toward the inside of the flacon 12. The diameter of the blind axial seating 14 is sized according to the maximum transverse size of the mobile thruster 15 intended to slide inside it. The mobile thruster 15 therefore occupies, with its maximum transverse bulk, substantially the whole space of the blind axial seating 14.

In some forms of embodiment, the closing stopper 13 also comprises an annular surface 19 which connects and joins, in this case in a substantially radial direction, or slightly inclined, the first wall 17 to the second wall 18.

In particular, the first wall 17 extends axially, in normal use downward, from the annular surface 19, whereas the second cylindrical wall 18 extends axially in the opposite direction, in normal use upward, from the annular surface 19.

The annular surface 19, during use, faces toward the inside of the flacon 12 and extends radially, or slightly inclined, from the central aperture 21 to the first wall 17.

In some forms of embodiment, the tank 16 is associated with the annular surface 19, advantageously by gluing or heat-welding. This constraint, by gluing or heat-welding, allows an internal hydraulic seal of the flacon 12, as will be explained in more detail hereafter.

In some forms of embodiment, the tank 16 is assembled "upside down", that is, with the protuberance 16*b* facing downward. In particular, the planar wall 16*a* of the tank 16 is directly constrained, for example by gluing or heat-welding, to the annular surface 19, so that the protuberance 16*b* is facing toward the inside of the flacon 12. In this case it is advantageous that the annular surface 19 is also substantially planar, extending radially from the center toward the periphery, for the optimum positioning of the planar wall 16*a* of the tank 16.

In some forms of embodiment, the first wall 17 of the closing stopper 13 comprises an internal surface on which a threading 20 is made that functions as a closing mean for the releasable connection with the neck 11 of the flacon 12. in this form of embodiment, the neck 11 has a mating counter-threaded portion on the outside, to cooperate with the threading 20.

In some forms of embodiment, the first wall 17 comprises an external gripping surface, in this case knurled to facilitate gripping the device 10.

In some forms of embodiment, an annular rib 22, also known as "tige" in French, extends from the annular surface 19 toward the inside of the flacon 12, in an intermediate position between the central aperture 21 and the first cylindrical wall 17. In some forms of embodiment, the annular rib 22 is substantially orthogonal to the annular surface 19. In other forms of embodiment, as illustrated in more detail hereafter, the annular rib 22 is inclined with respect to the annular surface 19, that is, it has a desired degree of truncated conicity which, taking into account the relative flexibility with respect to the material of the flacon 12, allows coupling and seal.

In some forms of embodiment, the annular rib 22 divides the annular surface 19 on an external side, in cooperation with the first wall 17, into an annular interstice 24, delimiting a first crown or external annular strip 23, and on an internal side, in cooperation with the central aperture 21, a second crown or internal annular strip 25.

Figure 2:
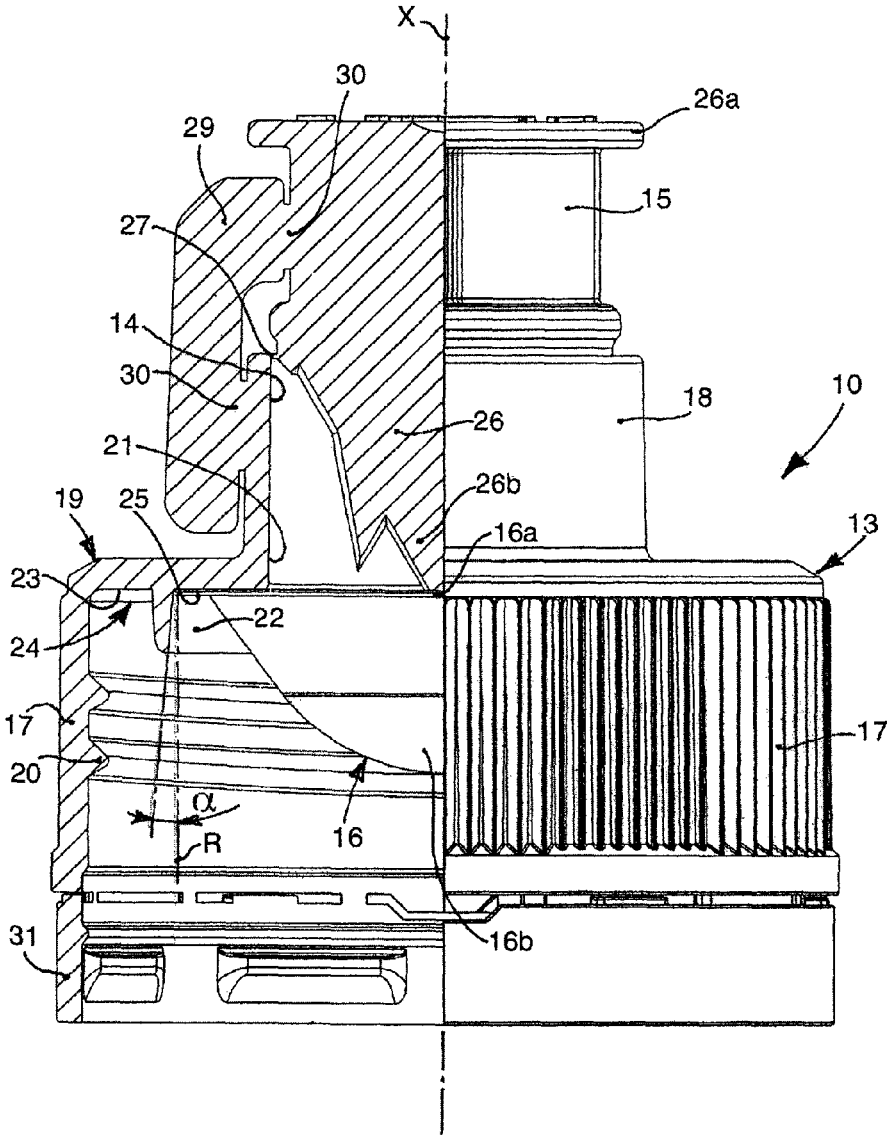
FIG. 2 shows a lateral, partly sectioned view of the device in FIG. 1 alone.

In some forms of embodiment, the first crown 23 is thus defined between the annular rib 22 and the first cylindrical wall 17, and allows to house an upper annular band 11*a* (FIG. 1) of the neck 11 of the flacon 12 in the annular interstice 24. As can be seen in FIGS. 1 and 2, the annular rib 22 is in direct abutment against the upper annular band 11*a* of the neck 11. In this way, the upper annular band 11*a* of the neck 11 goes into close contact with the annular rib 22, allowing to obtain a desired external hydraulic seal of the flacon 12. Moreover, inserting the the upper annular band 11*a* of the neck 11 into the annular interstice 24 allows the threading 20 to cooperate with the external counter-threaded surface of the neck 11, to determine the closing of the flacon 12.

The second crown 25 extends from the annular rib 22 to the central aperture 21 and has an amplitude such as to allow to position the tank 16 stably thereon, for example by gluing or heat-welding, in particular the planar wall 16*a*. In this way, the tank 16 substantially closes the central aperture 21.

In some forms of embodiment of the present invention, the external hydraulic seal of the flacon is obtained with the annular rib 22 that extends directly from the annular surface 19 above the closing portion 13 and defines the external annular interstice 24 where it cooperates with the upper annular band 11*a* of the neck 11 of the flacon 12, whereas the internal hydraulic seal is obtained thanks to the constraint, by gluing or heat-welding, of the tank 16 to the annular surface 19 of the closing portion 13, but in a more internal position with respect to the annular rib 22. There is therefore no need for additional packings.

As mentioned above, in some forms of embodiment, the annular rib 22 is tapered, that is, it has a section that progressively narrows, or in any case has a desired degree of truncated conicity, toward the center of the flacon 12 in its development toward the lying plane of the annular surface 19 (in the attached drawings from bottom to top), so as to cooperate with the neck 11 of the flacon 12 and define a hydraulic seal of the coupling between the device 10 and the flacon 12.

Advantageously, the taper of the annular rib 22 defines a determinate angle $\alpha$ of inclination between about 3° and about 10° with respect to a reference plane R parallel to the central axis X of the closing device 10. The coupling of the neck 11 with the tapered rib 22 determines a slight lateral flexion of the latter, and the seal is obtained.

In some forms of embodiment, the mobile thruster 15 is formed by a rod 26 disposed sliding inside the central aperture 21 and provided with a first end 26*a* outside the closing stopper 13 and a second pointed end 26*b* inside the closing stopper 13. In some forms of embodiment where the mobile thruster 15 functions as a perforator of the tank 16, at least the second end 26*b* of the rod 26 has a substantially star-shaped or cross-shaped cross section, to effectively cut the material that makes up the tank 16, in this case a star with four points, orthogonal to each other.

In particular, in some forms of embodiment the rod 26 is made in a single body with the closing stopper 13 and is connected to the latter by means of a profile of preferential breaking 27. The profile of preferential breaking 27, in a condition of non-use, keeps the mobile thruster 15 solid with the closing stopper 13 whereas, when the profile of preferential breaking 27 is broken by the pressure of the user, the mobile thruster 15 is free to slide with respect to the closing stopper 13 along the axial seating 14. In some forms of embodiment, the profile of preferential breaking 27 is made along the upper part of the second wall 18, to connect the latter with the rod 26 (FIGS. 1 and 2).

The rod 26 thus defines a first position of the mobile thruster 15, in which it is kept raised from the profile of preferential breaking 27 and does not interfere with the tank 16. In some forms of embodiment, at least part of the rod 26 and the profile of preferential breaking 27 define, in said first raised position, the bottom of the blind axial seating 14 in which, during normal use, the mobile thruster 15 slides.

An axial thrust on the first end 26*a* of the rod 26 determines the breakage of the profile of preferential breaking 27 and causes the mobile thruster 15 to slide toward the flacon 12, inside the axial seating 14.

In this way a second position of the mobile thruster 15 is defined, in which the second end 26*b* of the rod 26 protrudes from the central aperture 21 and, in this case, perforates or cuts the tank 16 in through manner, thus allowing the first component contained therein to fall freely inside the flacon 12 and to mix with the second component, or at least to be dispersed therein.

The device 10 also comprises a safety element, in this case a safety tongue 29 made in a single piece both with respect to the rod 26 and also with respect to the closing stopper 13, so as to prevent, at least temporarily, any reciprocal movement thereof.

In particular, the safety tongue 29 is connected to the rod 26 and the closing stopper 13 by means of respective pre-cut segments 30, easily breakable.

Therefore, the movement of the rod 26 to move the mobile thruster 15 from the first position to the second position is allowed only after the safety tongue 29 has been removed.

Figure 3:
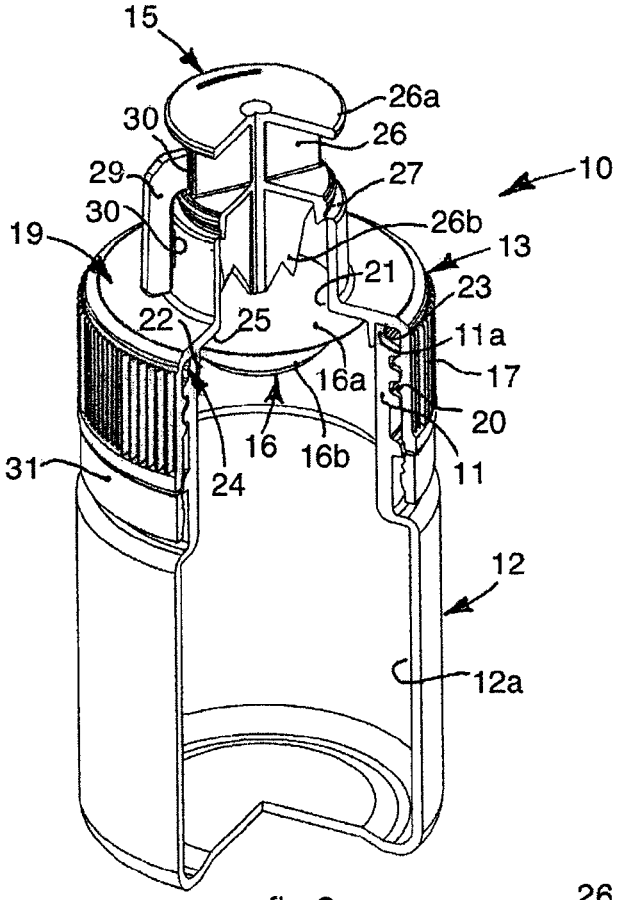
FIG. 3 is a three-dimensional view of the device according to the present invention in a first operating condition.
Figure 4:
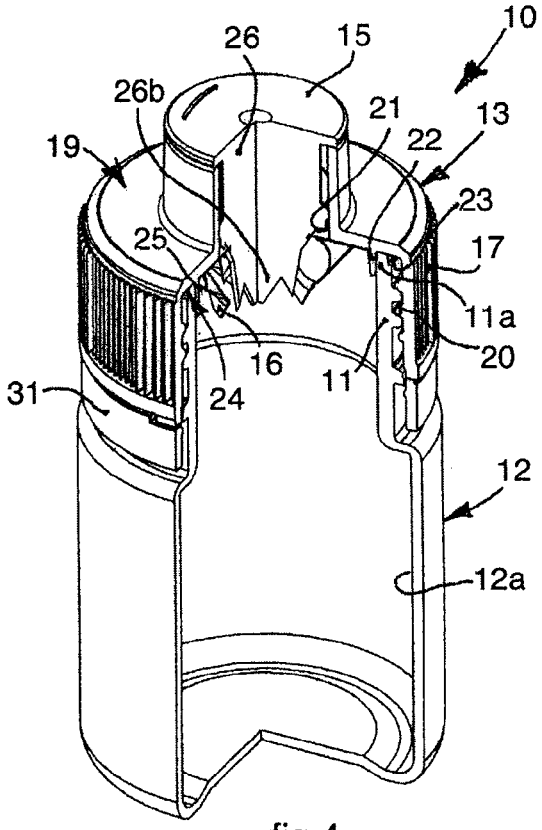
FIG. 4 is a three-dimensional view of the device according to the present invention in a second operating condition.
Figure 5:
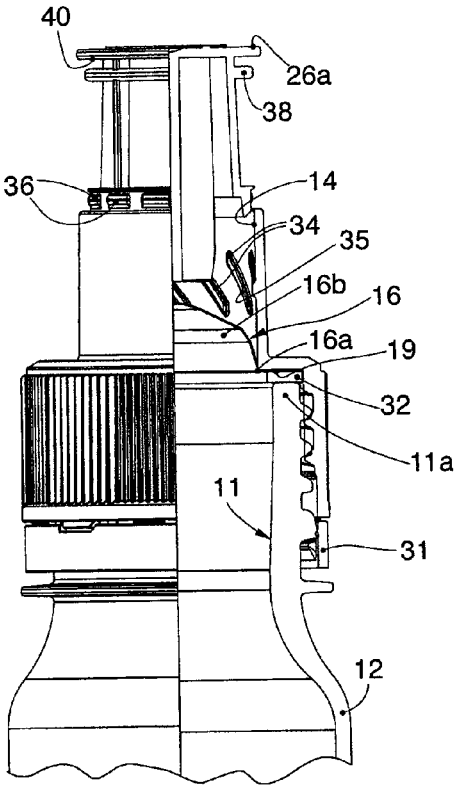
FIG. 5 shows a lateral, partly sectioned view of a variant of the present invention applied to a flacon in a first operating condition.
Figure 6:
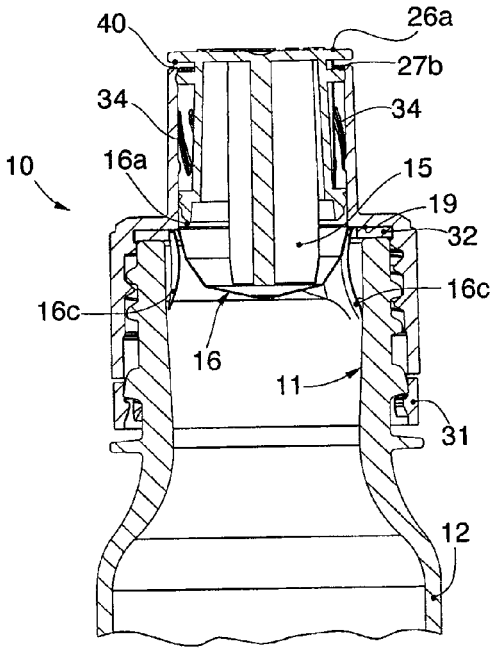
FIG. 6 shows a section of a variant of the present invention applied to a flacon in a second operating condition.
Figure 7:
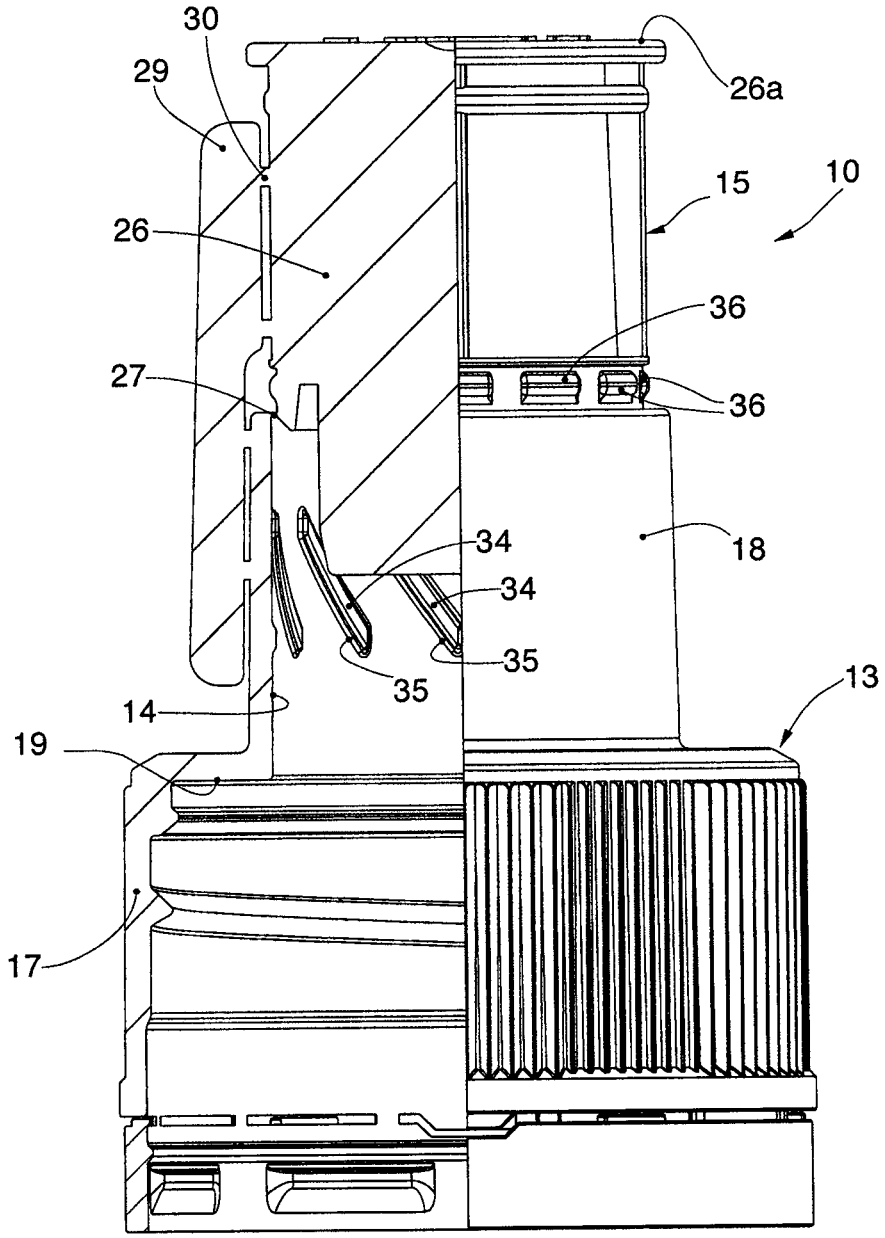
FIG. 7 shows an enlarged detail of part of one form of embodiment of the present invention.
Figure 8:
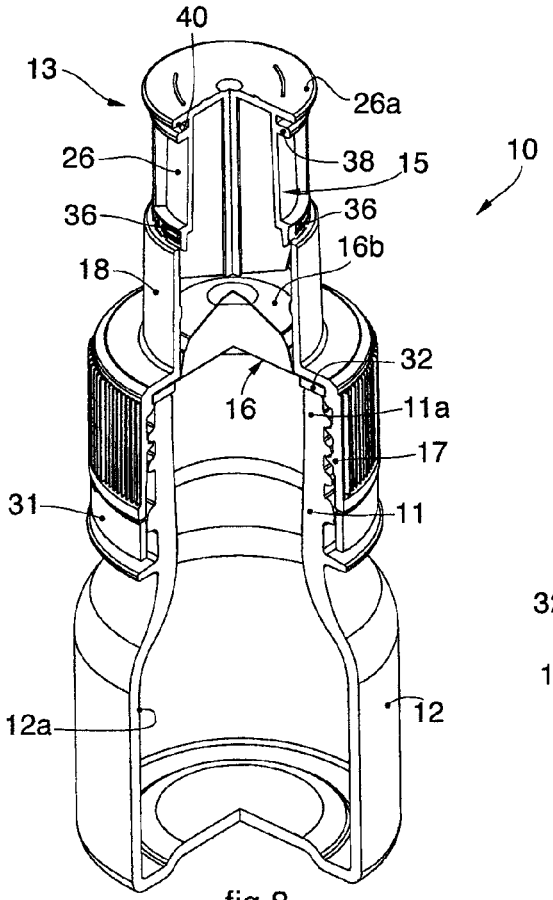
FIG. 8 is a partly sectioned three-dimensional view of the device according to the present invention in a first operating condition.
Figure 9:
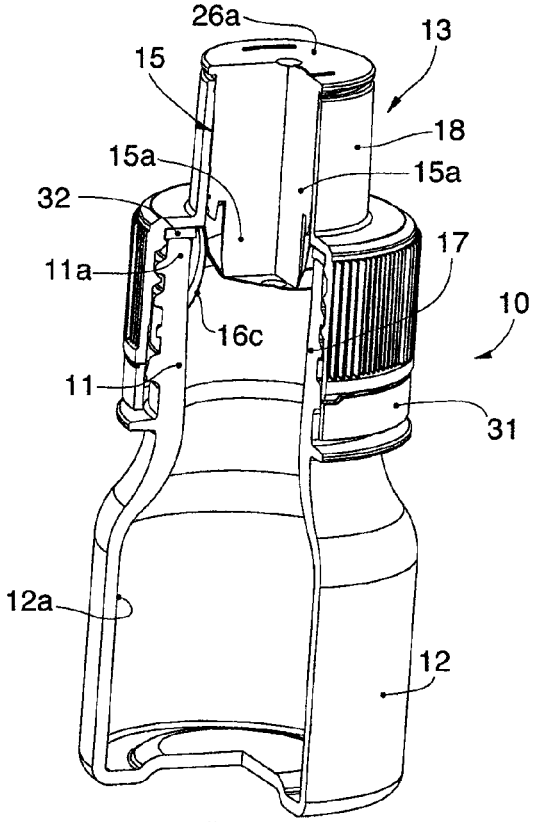
FIG. 9 is a partly sectioned three-dimensional view of the device according to the present invention in a second operating condition.

In some forms of embodiment, an anti-tampering element is provided between the closing device 10 and the flacon 12, to prevent the uncoupling of the two parts. In some forms of embodiment, the anti-tampering element is an annular strip 31 that connects the closing device 10 to the flacon 12 (FIGS. 1, 2 and 3). It has a structure, for example made of thin plastic, which surrounds the flacon 12, and is solid both with the latter and also with the closing device 10, thus in practice preventing their uncoupling. The annular strip 31 has preferential breaking segments which, once forced, allow to remove it and to uncouple, in this case by unscrewing, the closing device 10 from the flacon 12.

The closing device 10 and the associated flacon 12 are used as follows. Once the safety tongue 29 has been removed, the user thrusts the mobile thruster 15 so that it interferes with the tank 16, in this case cutting it in through manner, thus allowing the first component to fall freely into the internal compartment 12*c* of the flacon, to be mixed, or dispersed, for example by manual shaking, in the second component, to prepare the composition to be drunk.

The anti-tampering annular strip 31 is removed so that the stopper 13 is completely removed.

Once these operations have been performed, thanks to the releasable connection between the closing stopper 13 and the neck 11 of the flacon 12, the user completely removes the closing stopper 13, for example by unscrewing it or in some other way, and can easily drink the composition prepared inside the flacon 12 through the aperture delimited by the neck 11, for example drinking directly from the neck 11.

It also comes within the field of the present invention to provide that on the inner surface of the first cylindrical wall 17, instead of the threading 20, ribs, ridges or other are provided, to define, for example, a snap-in attachment, a releasable coupling or other, between the device 10 and flacon 12.

FIGS. 5-9 show other forms of embodiment of the present invention, in which the same reference numbers are used for identical parts.

In particular, in these forms of embodiment the annular rib 22 may not be obtained; instead, an annular packing 32 is provided for the hydraulic seal, advantageously made of elastomer material, between the neck 11 of the flacon 12 and the tank 16, in abutment against the annular surface 19. In this case, the compression of the annular packing given by closing the closing stopper 13 on the neck 11 of the flacon 12 guarantees the hydraulic seal.

Furthermore, as shown for example in FIGS. 5-9, in some forms of embodiment the tank 16 is located upside down with respect to FIGS. 1-4, with the planar wall 16*a* facing toward the inside of the flacon 12 and the protuberance 16*b* containing the first component faces toward the mobile thruster 15, in particular housed inside the axial seating 14. In this variant solution, the thrusting action of the mobile thruster 15 determines the breakage of the tank 16, preferably only the planar wall 16*a*, which opens with breakage edges 16*c* facing downward inside the flacon 12, allowing the first component to fall.

In particular, a perimeter annular strip of the planar wall 16*a* of the tank 16 is associated in abutment when the closing stopper 13 is closed on the neck 11 of the flacon 12, against the annular surface 19 of the closing stopper 13, and in these forms of embodiment it rests on and is indirectly supported by the upper annular band 11*a* of the neck 11 of the flacon 12. The annular packing 32 is provided between the planar wall 16*a* of the tank 16 and the upper annular band 11*a*. The width or radial extension of the annular packing 32 can be sized and selected depending on the width of the annular surface 19 of the closing stopper 13, preferably not exceeding said width.

In some forms of embodiment, the axial seating 14 of the closing stopper 13 has guide ribs or ridges 34 inside it, which develop mainly in an axial direction, made on the inner surface of the axial seating 14 with a predefined pitch from each other so as to define sliding channels 35.

The guide ribs 34 cooperate with the mobile thruster 15 in the movement of the latter downward, guiding and facilitating the movement thereof and its interaction with the tank 16.

Advantageously, the mobile thruster 15 has sliding teeth 36 on its perimeter, provided in this case above the profile of preferential breakage 27, and able to cooperate with the guide ribs or ridges 34.

The sliding teeth 36 protrude from the outer surface of the mobile thruster 15 and are made with a predefined pitch coordinated with the pitch at which the guide ribs or ridges 34 are made. When the mobile thruster 15 is actuated, the sliding teeth 36 are forced to slide in guided manner on the surface of the guide ribs or ridges 34 along the corresponding sliding channels 35.

The position of the sliding teeth 36 in the first position of the mobile thruster 15 is aligned substantially with the inlet or mouth of each of the corresponding sliding channels 35, so that once the mobile thruster 15 is driven, there is a univocal insertion of the sliding teeth 36 inside them.

In this case the guide ribs or ridges 34 are shaped as protruding segments with a mainly helical development along the axial direction of movement of the mobile thruster 15, forcing the latter to move axially along a substantially helical trajectory, facilitating the sliding of the sliding teeth 36 on the surface of the guide ribs or ridges 34 and determining a thrust with rotation on the tank 16, which can further facilitate the opening thereof. Indeed, the substantially helical movement of the mobile thruster 15 facilitates a wide opening of the edges 16*c* of the planar wall 16*a* once it has opened, preventing even a minimum quantity of the first component from remaining trapped or retained by the edges 16*c*.

In this case, the upper portion of the closing stopper 13 comprises, below the first end 26*a*, a circumferential ridge 38 which, in cooperation with the first end 26*a*, delimits a circular retaining groove 40 which is useful when the mobile thruster 15 is moved into the second position. Indeed, the breakage of the preferential breakage line 27 determines the creation, on the top of the axial seating 14, of a portion 27*a* protruding radially, which cooperates with the groove 40, advantageously clamping the axial movement of the mobile thruster 15. The mechanical cooperation between portion 27*a* and groove 40 not only determines the clamping of the mobile thruster 15 in the second position, but also is so narrow that it also determines a mechanical hydraulic seal effect, preventing the liquid from undesirably coming out of the closing stopper 13 when the flacon 12 is shaken to mix the first component in the second component.

In the variants shown in FIGS. 5-9 the mobile thruster 15 does not cut or perforate the tank 16 directly, but only exerts a thrust on the protuberance 16*b*. The compression deriving from this thrust causes the planar wall 16*a* to break, which opens with the edges 16*c* facing downward, freeing the first component contained in the tank 16 and making it pass inside the flacon 12.

In these variants, the mobile thruster 15 is made with the rod 26 hollow; inside it there is a structure functioning as a thruster, with a cross-shaped cross section intended to thrust the protuberance 16*b*, in this case defined by two walls 15*a* which intersect orthogonally and are made by molding in a single body with the closing stopper 13, even though other forms may be provided or made, such as cylindrical, truncated cone or other, given that they perform the function of thrusting the tank 16.

Figure 10:
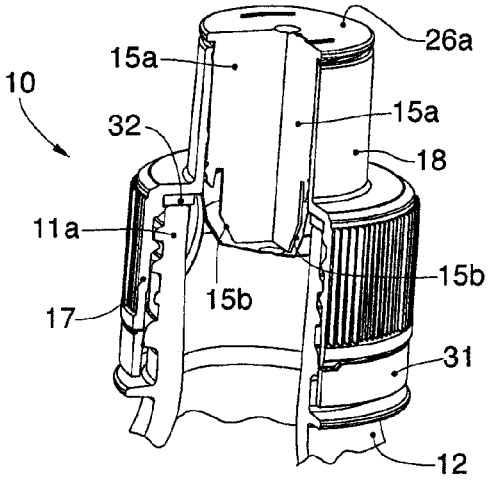
FIG. 10 shows an enlarged detail, partly in section, of a variant of one part of the present invention.

FIG. 10 shows a variant form of embodiment of the mobile thruster 15, in which the walls 15*a* have an inclined segment 15*b* at the lower part, advantageously rounded or beveled, which reduces the cross section of the mobile thruster 15. This variant, eliminating the interaction of the sharp edges of the mobile thruster 15 with the protuberance 16*b* of the tank 16, prevents a possible unwanted breakage thereof, when the mobile thruster 15 acts from above on the tank 16, thus further increasing the hydraulic seal of the closing stopper 13.

We claim:

1. A device for closing a container, suitable for containing a first component to be introduced into the container in addition to a second component contained in said container, comprising at least a tank suitable for containing said first component, a mobile thruster for opening the tank, a stable closing portion for the tank and provided with a closure able to cooperate with a neck of the container releaseably clamping with said container, said closing portion being suitable for housing slidingly inside the closing portion at least a part of said mobile thruster and including an opening for the passage of said mobile thruster toward said tank, said mobile thruster being selectively mobile between a first raised position of non-interference with the tank and a second lowered position in which said mobile thruster opens the tank so as to allow the passage of the first component inside the container, said closing portion having an annular surface facing toward the inside of the container when the closing portion is closed on the container, which surrounds said opening extending radially from said opening to said closure, said tank being stably associated with said annular surface, wherein the mobile thruster is made by molding in a single piece with the closing portion, defining a profile of preferential breakage connecting said mobile thruster and said closing portion and wherein the device comprises a safety element made in a single piece both with respect to said mobile thruster and also with respect to the closing portion, to prevent an accidental reciprocal movement of said mobile thruster with respect to said closing portion; and wherein said closing portion also comprises an annular rib that extends from the annular surface, in an intermediate position between said opening and said closing means, in order to define, on an external side, an annular interstice delimiting a first crown of the annular surface in which a part of the neck of the container is housed, for the closing cooperation with said closing means, so that an upper annular band of the neck cooperates with said annular rib, and, on an internal side, a second crown of the annular surface, for the stable positioning of the tank.

2. The device as in claim 1, wherein the second crown is configured to allow a disposition by gluing or heat-welding of the tank thereon, so that said tank is both in a condition of interference with the travel of the mobile thruster and also facing, toward the inside of the container when the closing portion is closed on the container.

3. The device as in claim 1, wherein the annular rib is tapered, having a section with an axial development that progressively narrows toward the annular surface.

4. The device as in claim 3, wherein the taper of the annular rib defines a determinate angle of inclination comprised between about 3° and about 10°, with respect to a reference plane substantially parallel to a central axis of said closing portion.

5. The device as in claim 1, wherein the device comprises an annular packing associated with the closing portion.

6. The device as in claim 5, wherein the annular packing is disposed between the annular surface of the closing portion and the upper annular band of the neck.

7. The device as in claim 5, wherein the annular packing is disposed between said tank and the upper annular band of the neck.

8. A device for closing a container, suitable for containing a first component to be introduced into the container in addition to a second component contained in said container, comprising at least a tank suitable for containing said first component, a mobile thruster for opening the tank, a stable closing portion for the tank and provided with a closure able to cooperate with a neck of the container releaseably clamping with said container, said closing portion being suitable for housing slidingly inside the closing portion at least a part of said mobile thruster and including an opening for the passage of said mobile thruster toward said tank, said mobile thruster being selectively mobile between a first raised position of non-interference with the tank and a second lowered position in which said mobile thruster opens the tank so as to allow the passage of the first component inside the container, said closing portion having an annular surface facing toward the inside of the container when the closing portion is closed on the container, which surrounds said opening extending radially from said opening to said closure, said tank being stably associated with said annular surface, wherein the mobile thruster is made by molding in a single piece with the closing portion, defining a profile of preferential breakage connecting said mobile thruster and said closing portion and wherein the device comprises a safety element made in a single piece both with respect to said mobile thruster and also with respect to the closing portion, to prevent an accidental reciprocal movement of said mobile thruster with respect to said closing portion; and wherein the closing portion has internally guide ribs cooperating with the mobile thruster in the passage from the first position to the second position.

9. The device as in claim 8, wherein the mobile thruster is provided with sliding teeth able to cooperate with said guide ribs.

10. The device as in claim 8, wherein said guide ribs have an axial development mainly along a helical trajectory.

11. A device for closing a container, suitable for containing a first component to be introduced into the container in addition to a second component contained in said container, comprising at least a tank suitable for containing said first component, a mobile thruster for opening the tank, a stable closing portion for the tank and provided with a closure able to cooperate with a neck of the container releaseably clamping with said container, said closing portion being suitable for housing slidingly inside the closing portion at least a part of said mobile thruster and including an opening for the passage of said mobile thruster toward said tank, said mobile thruster being selectively mobile between a first raised position of non-interference with the tank and a second lowered position in which said mobile thruster opens the tank so as to allow the passage of the first component inside the container, said closing portion having an annular surface facing toward the inside of the container when the closing portion is closed on the container, which surrounds said opening extending radially from said opening to said closure, said tank being stably associated with said annular surface, wherein the mobile thruster is made by molding in a single piece with the closing portion, defining a profile of preferential breakage connecting said mobile thruster and said closing portion and wherein the device comprises a safety element made in a single piece both with respect to said mobile thruster and also with respect to the closing portion, to prevent an accidental reciprocal movement of said mobile thruster with respect to said closing portion; and wherein the safety element is connected to the mobile thruster and to the closing portion by relative pre-cut segments conformed to facilitate the removal of said safety element.

12. A device for closing a container, suitable for containing a first component to be introduced into the container in addition to a second component contained in said container comprising at least a tank suitable for containing said first component, a mobile thruster for opening the tank, a stable closing portion for the tank and provided with a closure able to cooperate with a neck of the container releaseably clamping with said container, said closing portion being suitable for housing slidingly inside the closing portion at least a part of said mobile thruster and including an opening for the passage of said mobile thruster toward said tank, said mobile thruster being selectively mobile between a first raised position of non-interference with the tank and a second lowered position in which said mobile thruster opens the tank so as to allow the passage of the first component inside the container, said closing portion having an annular surface facing toward the inside of the container when the closing portion is closed on the container, which surrounds said opening extending radially from said opening to said closure, said tank being stably associated with said annular surface, wherein the mobile thruster is made by molding in a single piece with the closing portion, defining a profile of preferential breakage connecting said mobile thruster and said closing portion and wherein the device comprises a safety element made in a single piece both with respect to said mobile thruster and also with respect to the closing portion, to prevent an accidental reciprocal movement of said mobile thruster with respect to said closing portion; and wherein the device comprises an anti-tampering element associated both with the closing portion and also with the container to selectively prevent the uncoupling thereof.

13. A device for closing a container, suitable for containing a first component to be introduced into the container in addition to a second component contained in said container, comprising at least a tank suitable for containing said first component, a mobile thruster for opening the tank, a stable closing portion for the tank and provided with a closure able to cooperate with a neck of the container releaseably clamping with said container, said closing portion being suitable for housing slidingly inside the closing portion at least a part of said mobile thruster and including an opening for the passage of said mobile thruster toward said tank, said mobile thruster being selectively mobile between a first raised position of non-interference with the tank and a second lowered position in which said mobile thruster opens the tank so as to allow the passage of the first component inside the container, said closing portion having an annular surface facing toward the inside of the container when the closing portion is closed on the container, which surrounds said opening extending radially from said opening to said closure, said tank being stably associated with said annular surface, wherein the mobile thruster is made by molding in a single piece with the closing portion, defining a profile of preferential breakage connecting said mobile thruster and said closing portion and wherein the device comprises a safety element made in a single piece both with respect to said mobile thruster and also with respect to the closing portion, to prevent an accidental reciprocal movement of said mobile thruster with respect to said closing portion; and wherein the mobile thruster is formed by walls which intersect orthogonally.

14. A device for closing a container, suitable for containing a first component to be introduced into the container in addition to a second component contained in said container, comprising at least a tank suitable for containing said first component, a mobile thruster for opening the tank, a stable closing portion for the tank and provided with a closure able to cooperate with a neck of the container releaseably clamping with said container, said closing portion being suitable for housing slidingly inside the closing portion at least a part of said mobile thruster and including an opening for the passage of said mobile thruster toward said tank, said mobile thruster being selectively mobile between a first raised position of non-interference with the tank and a second lowered position in which said mobile thruster opens the tank so as to allow the passage of the first component inside the container, said closing portion having an annular surface facing toward the inside of the container when the closing portion is closed on the container, which surrounds said opening extending radially from said opening to said closure, said tank being stably associated with said annular surface, wherein the mobile thruster is made by molding in a single piece with the closing portion, defining a profile of preferential breakage connecting said mobile thruster and said closing portion and wherein the device comprises a safety element made in a single piece both with respect to said mobile thruster and also with respect to the closing portion, to prevent an accidental reciprocal movement of said mobile thruster with respect to said closing portion; and wherein the mobile thruster has inclined segments.

15. A device for closing a container, suitable for containing a first component to be introduced into the container in addition to a second component contained in said container, comprising at least a tank suitable for containing said first component, a mobile thruster for opening the tank, a stable closing portion for the tank and provided with a closure able to cooperate with a neck of the container releaseably clamping with said container, said closing portion being suitable for housing slidingly inside the closing portion at least a part of said mobile thruster and including an opening for the passage of said mobile thruster toward said tank, said mobile thruster being selectively mobile between a first raised position of non-interference with the tank and a second lowered position in which said mobile thruster opens the tank so as to allow the passage of the first component inside the container, said closing portion having an annular surface facing toward the inside of the container when the closing portion is closed on the container, which surrounds said opening extending radially from said opening to said closure, said tank being stably associated with said annular surface, wherein the mobile thruster is made by molding in a single piece with the closing portion, defining a profile of preferential breakage connecting said mobile thruster and said closing portion and wherein the device comprises a safety element made in a single piece both with respect to said mobile thruster and also with respect to the closing portion, to prevent an accidental reciprocal movement of said mobile thruster with respect to said closing portion; and wherein the device comprises a clamping mechanism for mechanical clamping of the mobile thruster in the second position.

16. A device for closing a container, suitable for containing a first component to be introduced into the container in addition to a second component contained in said container, comprising at least a tank suitable for containing said first component, a mobile thruster for opening the tank, a stable closing portion for the tank and provided with a closure able to cooperate with a neck of the container releaseably clamping with said container, said closing portion being suitable for housing slidingly inside the closing portion at least a part of said mobile thruster and including an opening for the passage of said mobile thruster toward said tank, said mobile thruster being selectively mobile between a first raised position of non-interference with the tank and a second lowered position in which said mobile thruster opens the tank so as to allow the passage of the first component inside the container, said closing portion having an annular surface facing toward the inside of the container when the closing portion is closed on the container, which surrounds said opening extending radially from said opening to said closure, said tank being stably associated with said annular surface, wherein the mobile thruster is made by molding in a single piece with the closing portion, defining a profile of preferential breakage connecting said mobile thruster and said closing portion and wherein the device comprises a safety element made in a single piece both with respect to said mobile thruster and also with respect to the closing portion, to prevent an accidental reciprocal movement of said mobile thruster with respect to said closing portion; and wherein said tank comprises a planar wall and a hollow protuberance for containing the first component.

17. The device as in claim 16, wherein said planar wall faces toward the mobile thruster and said protuberance faces toward the inside of the container.

18. The device as in claim 16, wherein said planar wall faces toward the inside of the container and said protuberance faces toward the mobile thruster.

19. The device as in claim 18, wherein when the mobile thruster is moved from the first raised position to the second lowered position, the mobile thruster is capable of exerting a thrust on the protuberance to open the tank without perforating the tank directly.

20. The device as in claim 8, wherein said planar wall faces toward the mobile thruster and said protuberance faces toward the inside of the container.

21. The device as in claim 14, wherein the inclined segments are rounded or beveled.

22. The device as in claim 21, wherein said tank comprises a planar wall and a hollow protuberance for containing the first component; and wherein said planar wall faces toward the inside of the container and said protuberance faces toward the mobile thruster.

23. The device as in claim 22, wherein when the mobile thruster is moved from the first raised position to the second lowered position, the mobile thruster is capable of exerting a thrust on the protuberance to open the tank without perforating the tank directly.

24. The device as in claim 12, wherein the anti-tampering element is an annular strip connecting the closing device to the container.

25. The device as in claim 13, wherein the mobile thruster is formed by a rod having a first end and a second pointed end, wherein the second pointed end is configured to perforate the tank; and wherein the second pointed end is a star with four points.

26. The device as in claim 15, wherein the clamping mechanism comprises a radially protruding portion configured to cooperate with a groove defined by a circumferential ridge and a first end of the closing portion.

27. The device as in claim 1, wherein the safety element is connected to the mobile thruster and to the closing portion by means of relative pre-cut segments conformed to facilitate the removal of said safety element.

28. The device as in claim 8, wherein the safety element is connected to the mobile thruster and to the closing portion by means of relative pre-cut segments conformed to facilitate the removal of said safety element.

29. The device as in claim 1, wherein the device comprises an anti-tampering element associated both with the closing portion and also with the container to selectively prevent the uncoupling thereof.

30. The device as in claim 8, wherein the device comprises an anti-tampering element associated both with the closing portion and also with the container to selectively prevent the uncoupling thereof.

31. The device as in claim 11, wherein the device comprises an anti-tampering element associated both with the closing portion and also with the container to selectively prevent the uncoupling thereof.

32. The device as in claim 11, wherein the device comprises an annular packing associated with the closing portion.

33. The device as in claim 32, wherein the annular packing is disposed between the annular surface of the closing portion and the upper annular band of the neck.

34. The device as in claim 32, wherein the annular packing is disposed between said tank and the upper annular band of the neck.

35. The device as in claim 1, wherein the mobile thruster comprises at least a rod mounted sliding in said closing portion and provided with a first drive end and a second pointed end for breaking the tank.

36. The device as in claim 8, wherein the mobile thruster comprises at least a rod mounted sliding in said closing portion and provided with a first drive end and a second pointed end for breaking the tank.

37. The device as in claim 11, wherein the mobile thruster comprises at least a rod mounted sliding in said closing portion and provided with a first drive end and a second pointed end for breaking the tank.

38. The device as in claim 12, wherein the mobile thruster comprises at least a rod mounted sliding in said closing portion and provided with a first drive end and a second pointed end for breaking the tank.

39. The device as in claim 13, wherein the mobile thruster comprises at least a rod mounted sliding in said closing portion and provided with a first drive end and a second pointed end for breaking the tank.

40. The device as in claim 14, wherein the mobile thruster comprises at least a rod mounted sliding in said closing portion and provided with a first drive end and a second pointed end for breaking the tank.

41. The device as in claim 15, wherein the mobile thruster comprises at least a rod mounted sliding in said closing portion and provided with a first drive end and a second pointed end for breaking the tank.

42. The device as in claim 16, wherein the mobile thruster comprises at least a rod mounted sliding in said closing portion and provided with a first drive end and a second pointed end for breaking the tank.

43. The device as in claim 1, wherein said tank is made based on a metal associated with a polymer, to guarantee a barrier against humidity and oxygen and the weldability of the closing portion.

44. The device as in claim 8, wherein said tank is made based on a metal associated with a polymer, to guarantee a barrier against humidity and oxygen and the weldability of the closing portion.

45. The device as in claim 11, wherein said tank is made based on a metal associated with a polymer, to guarantee a barrier against humidity and oxygen and the weldability of the closing portion.

46. The device as in claim 12, wherein said tank is made based on a metal associated with a polymer, to guarantee a barrier against humidity and oxygen and the weldability of the closing portion.

47. The device as in claim 13, wherein said tank is made based on a metal associated with a polymer, to guarantee a barrier against humidity and oxygen and the weldability of the closing portion.

48. The device as in claim 14, wherein said tank is made based on a metal associated with a polymer, to guarantee a barrier against humidity and oxygen and the weldability of the closing portion.

49. The device as in claim 15, wherein said tank is made based on a metal associated with a polymer, to guarantee a barrier against humidity and oxygen and the weldability of the closing portion.

50. The device as in claim 16, wherein said tank is made based on a metal associated with a polymer, to guarantee a barrier against humidity and oxygen and the weldability of the closing portion.

51. A container comprising the closing device as in claim 1.

52. A container comprising the closing device as in claim 8.

53. A container comprising the closing device as in claim 11.

54. A container comprising the closing device as in claim 12.

55. A container comprising the closing device as in claim 13.

56. A container comprising the closing device as in claim 14.

57. A container comprising the closing device as in claim 15.

58. A container comprising the closing device as in claim 16.

* * * * *